US008261650B2

(12) United States Patent
Hagspiel et al.

(10) Patent No.: US 8,261,650 B2
(45) Date of Patent: Sep. 11, 2012

(54) COCKING DEVICE FOR A BOLT MECHANISM

(75) Inventors: Oliver Hagspiel, Oberstaufen (DE); Peter Wiedemann, Scheuring (DE)

(73) Assignee: Blaser Finanzholding GmbH, Isny (DE)

( * ) Notice: Subject to any disclaimer, the term of this patent is extended or adjusted under 35 U.S.C. 154(b) by 107 days.

(21) Appl. No.: 12/960,665

(22) Filed: Dec. 6, 2010

(65) Prior Publication Data

US 2011/0131856 A1 Jun. 9, 2011

(30) Foreign Application Priority Data

Dec. 9, 2009 (DE) ..... 10 2009 057 569

(51) Int. Cl.
*F41A 19/34* (2006.01)

(52) U.S. Cl. ..... 89/1.4; 89/154; 42/69.01; 42/69.02; 42/70.01

(58) Field of Classification Search ..... 42/69.01–69.02, 42/70.01–70.06, 70.08; 89/1.4, 148, 150, 89/154

See application file for complete search history.

(56) References Cited

U.S. PATENT DOCUMENTS

| | | | | |
|---|---|---|---|---|
| 2,699,006 | A * | 1/1955 | Maerk | 42/10 |
| 2,699,007 | A * | 1/1955 | Maerk | 42/11 |
| 4,450,752 | A * | 5/1984 | Donovan | 89/142 |
| 4,475,437 | A * | 10/1984 | Sullivan | 89/148 |
| 4,502,367 | A * | 3/1985 | Sullivan | 89/181 |
| 4,505,182 | A * | 3/1985 | Sullivan | 89/132 |
| 7,201,094 | B2 * | 4/2007 | Jebsen et al. | 89/189 |
| 7,997,183 | B2 * | 8/2011 | Jebsen et al. | 89/177 |
| 8,042,450 | B2 * | 10/2011 | Doll et al. | 89/148 |
| 8,122,633 | B2 * | 2/2012 | Kerbrat et al. | 42/20 |
| 2010/0077643 | A1 * | 4/2010 | Kerbrat et al. | 42/1.06 |
| 2011/0314716 | A1 * | 12/2011 | Jebsen et al. | 42/1.06 |

FOREIGN PATENT DOCUMENTS

| | | | |
|---|---|---|---|
| DE | 42234498 | A1 | 2/1994 |
| DE | 202004016800 | U1 | 9/2005 |

* cited by examiner

*Primary Examiner* — Michael David

(74) *Attorney, Agent, or Firm* — Martin Fleit; Paul D. Bianco; Fleit Gibbons Gutman Bongini & Bianco PL

(57) ABSTRACT

The invention concerns a cocking device for a bolt mechanism with a cocking slider (13, 14), which can be displaced, on a breech housing (2), between a rear uncocking position and a front cocking position, for the cocking and uncocking of a striker spring and a catch (21), located on the cocking slider (13, 14), which works together with a mating catch (23) to hold the cocking slider (13, 14) in the front cocking position. In order to attain an improved safety with respect to an unintended release of a shot, an uncocking mechanism (25, 29) for the automatic uncocking of the striker spring (48), when the magazine (5) has been removed, is correlated with the cocking slider (13, 14).

10 Claims, 3 Drawing Sheets

COCKING DEVICE FOR A BOLT MECHANISM

FIELD OF THE INVENTION

The invention concerns a cocking device for a bolt mechanism.

BACKGROUND OF THE INVENTION

Such a cocking device is known from DE 42 23 498 C2. There, a cocking slider for the cocking and uncocking of a striker spring, which can be displaced between a rear uncocking position and a front cocking position, is located on a breech housing of a rifle. The cocking slider has an upper slider part, which projects upward from the breech housing, and a lower catch part with a catch, which is located in the breech housing. The catch of the cocking slider is intended to mesh with a mating catch, which is located firmly on the breech housing, to hold the cocking slider in the front cocking position. With this known cocking device, the cocking slider for the cocking of the striker spring on the upper slider part can be pushed forward and meshes into the corresponding mating catch on the breech housing, in the front cocking position, with its catch, provided on the rear end of the catch part. By pressing on the rear end of the slider part, it is possible to press out the catch from the mating catch, wherein the cocking slider again arrives at its rear uncocked position, with the uncocking of the striker spring.

SUMMARY OF THE INVENTION

The goal of the invention is to create a cocking device of the type mentioned in the beginning, which has an improved safety with respect to the unintended release of a shot.

This goal is attained by a cocking device as set forth in the claims. Appropriate developments and advantageous refinements of the invention are given in the subclaims.

In the cocking device in accordance with the invention, an uncocking mechanism for the automatic uncocking of the striker spring when a magazine is removed is correlated with the cocking slider. If the magazine is removed from a magazine well of the rifle or is not correctly inserted into the magazine well, then the cocking slider is automatically pushed into its retracted uncocked position and in this way, the striker spring is uncocked. With the removal or incorrect locking of the magazine, therefore, the striker spring is automatically uncocked and cannot be cocked into the cocking position even with a displacement of the cocking slider. Even if there is still a cartridge in the cartridge chamber, a shot cannot be released, wherein an increased safety of the rifle is attained.

In a particularly appropriate embodiment, the uncocking mechanism has a catch plate in the breech housing, which can displaced between a rear safety position and a front catch position, on which the mating catch for the catch of the cocking slider is located. If the catch plate is located in the rear safety position, the catch of the cocking slider in the front cocking position has no abutment, so that the striker spring cannot be cocked. The holding of the catch plate in the front catch position, with a properly inserted magazine or the release of the catch plate for the displacement into the rear safety position, with the removed or improperly inserted magazine, takes place via a blocking element, arranged as, for example, a blocking fork, which is located in the breech housing.

The blocking element is appropriately movable via an actuation mechanism, located in a system casing, between a lowered position for the holding of the catch plate in the front catch position and a raised position for the release of the catch plate for its displacement into the rear safety position.

The actuation mechanism appropriately comprises one or more pressure pins, arranged in a displaceable manner on a carrier; they can be moved upon insertion of the magazine, via rocker levers, into a retracted position, and upon removal of the magazine, via springs into an extended position to push the blocking element into the raised position for the release of the catch plate.

The blocking element is preferably designed as a blocking fork with a placement surface for a rear end surface of the catch plate and a passage for the catch plate located below the placement surface.

BRIEF DESCRIPTION OF THE DRAWINGS

Other special features and advantages of the invention can be deduced from the following description of a preferred embodiment example with the aid of the drawing. The figures show the following.

DETAILED DESCRIPTION OF THE INVENTION

Figure 1:
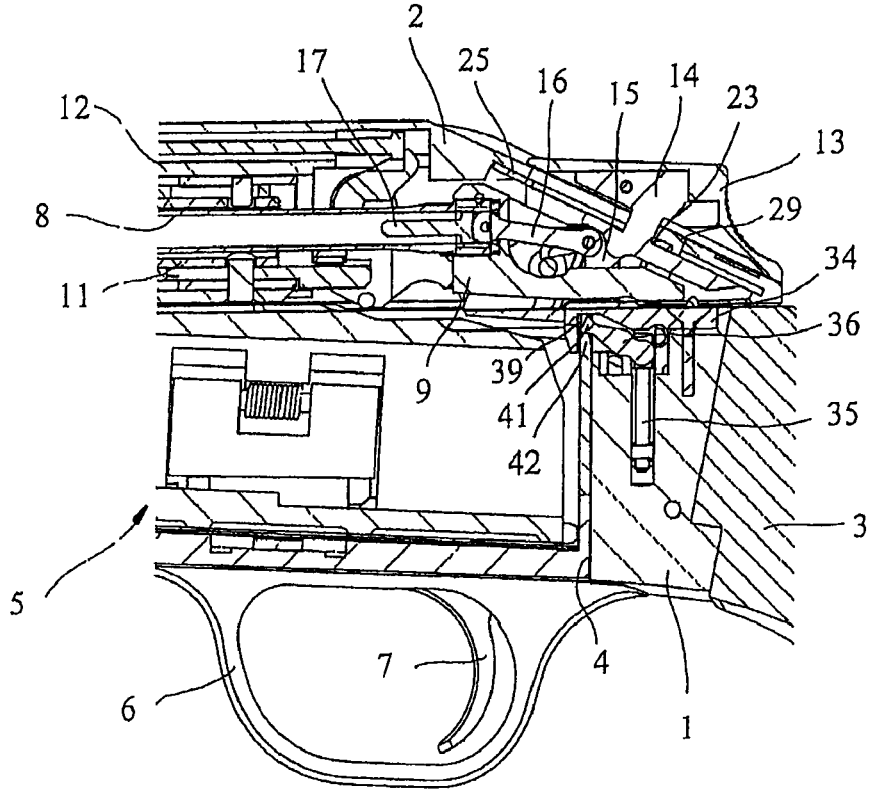
FIG. 1, a partial view of a repeating rifle with an uncocked cocking device and a magazine inserted in the longitudinal section.
Figure 2:
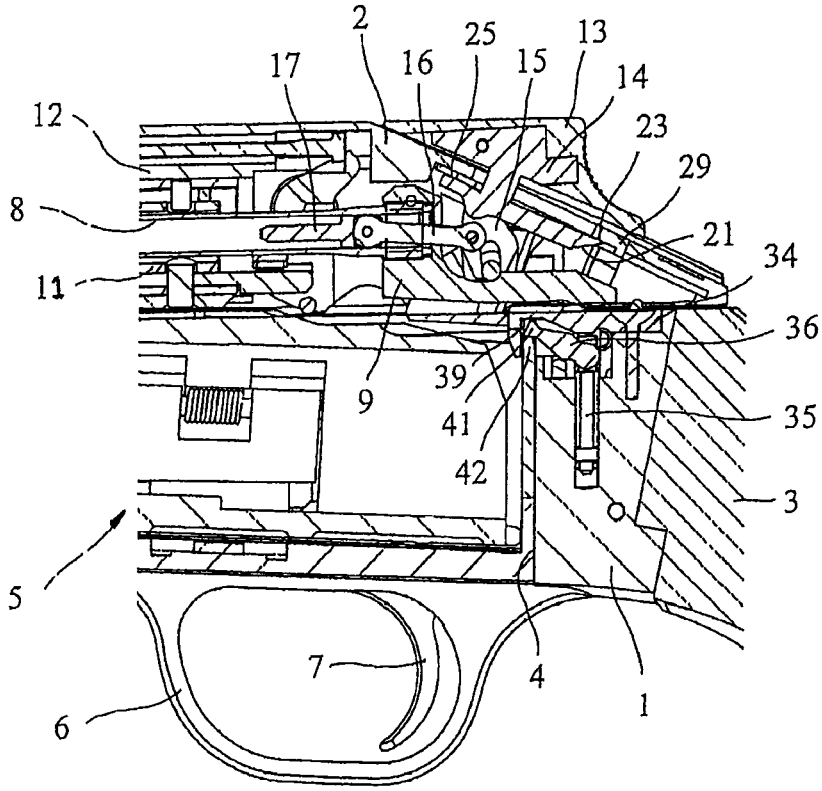
FIG. 2, a partial view of the repeating rifle of FIG. 1, with a cocked cocking device.
Figure 3:
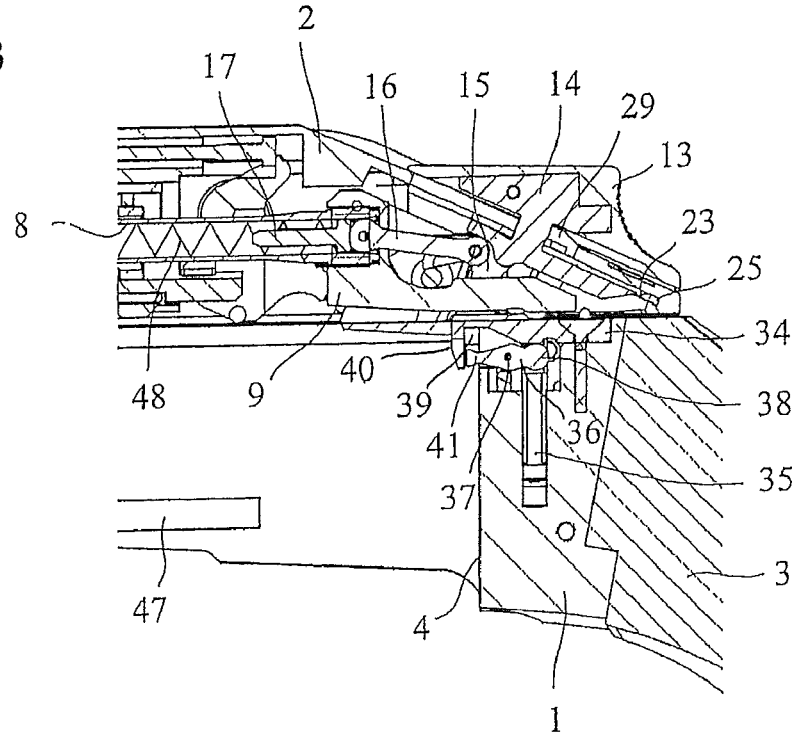
FIG. 3, a partial view of a repeating rifle, with an uncocked cocking device, with the magazine removed.

FIGS. 1-3 show a part of a repeating rifle with a system casing 1, a bolt mechanism 2 arranged in a displaceable manner on the system casing 1, a rear shaft 3 affixed on the rear side of the system casing 1, and a magazine 5 inserted in a magazine well 4 from the underside of the system casing 1. In the embodiment example shown, the trigger guard 6 with the trigger 7 is located on the underside of the magazine 5. The trigger guard 6 and the trigger 7 are therefore firmly connected to the magazine 5 in this embodiment, so that they remain on the magazine 5 even with the removal of the magazine 5 from the repeating rifle. If the magazine 5 is removed, then the trigger device can also no longer be actuated.

A striking pin 8 with a cocking piece 9 is located in the breech housing 2. The cocking piece 9 is connected to a trigger mechanism—not shown in more detail here—which is located in the system casing 1; the trigger mechanisms cannot be actuated with an inserted magazine 5, due to a projection 10 of the trigger 7, which can be seen in FIG. 4. There is also a locking chamber 11 with a locking element 12, designed as an expansion sleeve, accommodated in the breech housing 2.

Figure 5:
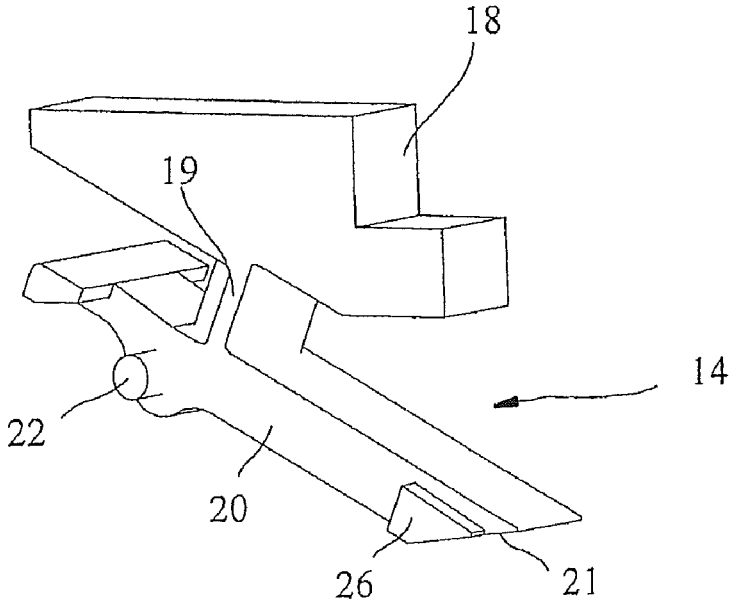
FIG. 5, an enlarged representation of the lower part of a cocking slider from the cocking device of FIGS. 1-4.

A cocking slider with an upper cocking slider part 13 and a lower cocking slider part 14, shown separately in FIG. 5, is arranged in a displaceable manner between an uncocking position, shown in FIG. 1, and a cocking position, shown in FIG. 2, on the rear end of the breech housing 2, descending at a slant toward the rear. The lower cocking slider part 14 is connected to a cocking pin 17, located, in a displaceable manner, within the striking pin 8, via a fork piece 15 and an articulated lever 16. By displacement of the cocking pin 17, with the aid of the cocking slider, a striker spring 48, shown schematically in FIG. 3, can be cocked or uncocked within the striking pin 8.

From FIG. 5, it is clear that the lower cocking slider part 14 has an upper area 18, located in the upper cocking slider part 13, a middle cross-link 19, which is guided, in a displaceable manner, in a longitudinal slit of the breech housing 2, and a lower catch cross-link 20 with a catch 21, which is designed as a rear catch surface, at an incline. Via lateral pins 22 on the lower catch cross-link 20, the lower cocking slider part 14 is connected to the fork piece 15, in accordance with FIG. 4. The catch 21 is intended for placement on an opposite mating catch 23, at an incline, on the rear end of a longitudinal hole 24 in a catch plate 25, shown in FIG. 6.

Figure 6:
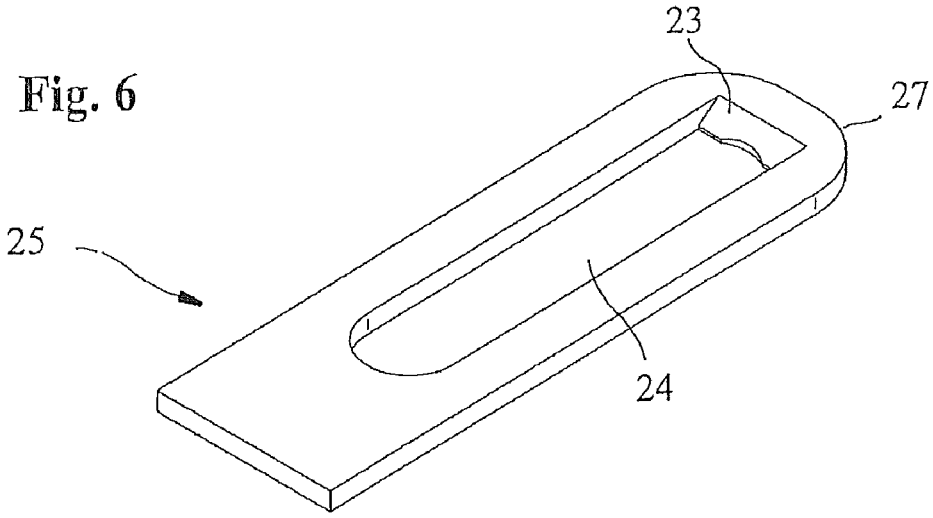
FIG. 6, an enlarged representation of a catch plate from the cocking device of FIGS. 1-4.

The catch plate 25, shown separately in FIG. 6, lies on the lower catch cross-link 20 of the lower cocking slider part 14 and is guided by lateral projections 26 on the catch cross-link 20. The catch plate 25 has a round end surface 27 on its rear end, for placement on a corresponding placement surface 28 of a blocking element 29, shown in FIG. 7.

Figure 7:
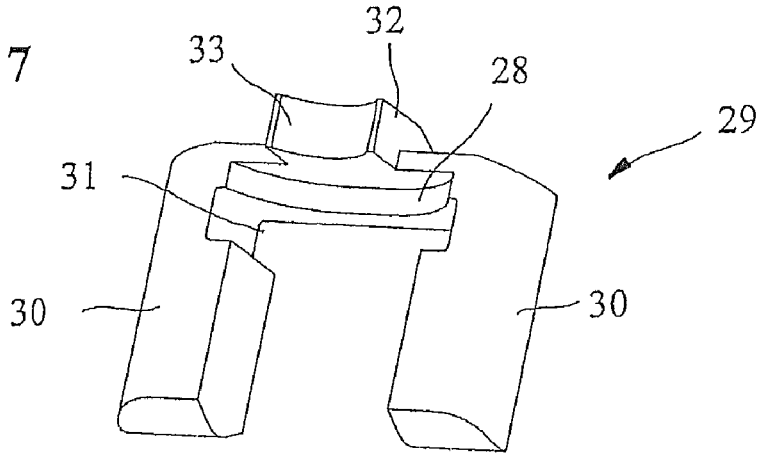
FIG. 7, an enlarged representation of a blocking element from the cocking device of FIGS. 1-4.

The blocking element 29, constructed here as a blocking fork, contains two parallel connecting pieces 30, projecting downward, in accordance with FIG. 7, with a slit-like passage 31, located below the placement surface 28, which has a somewhat larger width than the catch plate 25.

Furthermore, a projection 32 with a placement surface 33, which is rounded off inwardly, is provided on the upper side of the fork-like blocking element 29.

As can be seen from FIGS. 1-4, a carrier 34 with two vertically displaceable, parallel pressure pins 35, which are acted on upwardly by pressure springs, is placed in the system casing 1. The upper ends of the pressure pins 35 are intended for engagement with the lower ends of the two connecting pieces 30 of the blocking element 29. Moreover, two rocker levers 36, coupled with the pressure pins 35, are placed laterally on the carrier 34.

In FIG. 3, one can see that the rocker levers 36, which can swivel around axles 37 on the carrier 34, have a rear end 38, connected to the individual pressure pin 35, and a front end 41, which projects into a holding gap 39, between the magazine well 4 and a front projection 40 on the carrier 34. The rocker levers 36 are coupled with the pressure pins 35 in such a way that the upper ends of the pressure pins 35 are retracted upward into the carrier 34 by the swiveling of the front ends 41 of the rocker levers 36, and are pushed downward by the swiveling of the front ends 41 of the rocker levers 36, again upward via the force of the pressure springs, and thereby press the blocking element 29 upward into a raised position. The actuation of the rocker levers 36 takes place via the magazine 5, whose upper border 42 meshes into the holder gap 39 in the incorporation position of the magazine 5 shown in FIG. 1, and the front ends 41 of the rocker levers 36 are swiveled into the upper position, shown in accordance with FIG. 1. In this way, the upper ends of the pressure pins 35 are retracted into the carrier 34. If, on the other hand, the magazine 5 is removed in accordance with FIG. 3, then the rocker levers 36 are again rotated back, via the pressure springs on the pressure pins 35, so that the upper ends of the pressure pins 35 are again moved upward and the blocking element 29 is pushed into the raised position shown in accordance with FIG. 3.

Figure 4:
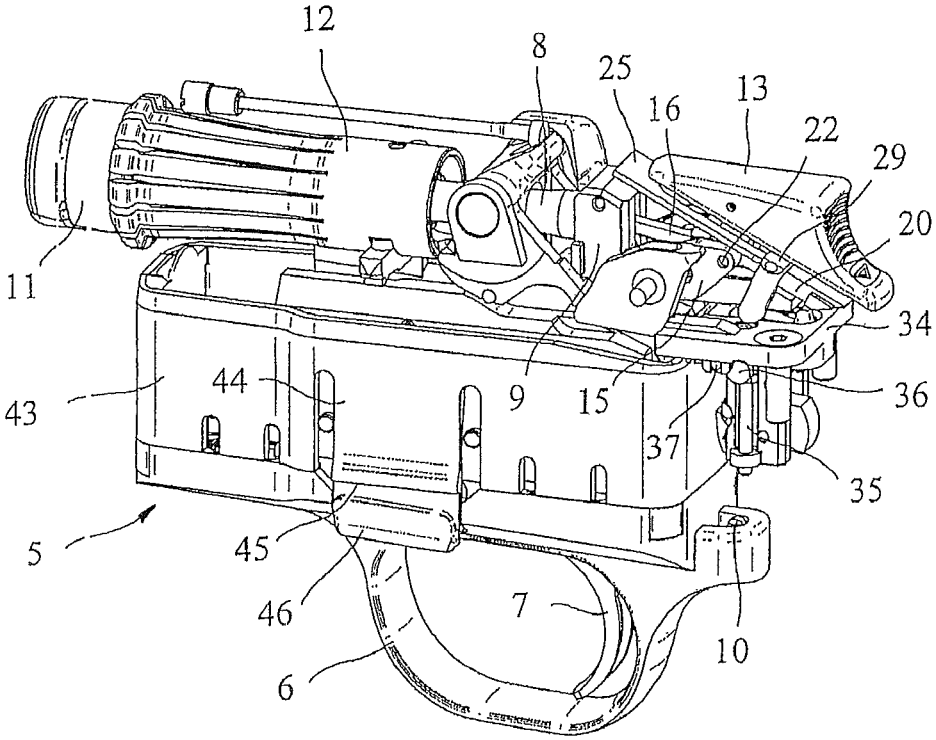
FIG. 4, a perspective view of the cocking device in an uncocked position, in accordance with FIG. 1.

FIG. 4 shows that laterally elastic flaps 44, with an upper locking lug 45 and a lower gripping part 46, are placed on the side walls of a housing 43 of the magazine 5. If the magazine 5 is correctly inserted into the magazine well, the locking lugs 45 mesh into indentations 47, shown in accordance with FIG. 3, on the lateral interior walls of the magazine well 4. To remove the magazine 5 from the magazine well 4, the two flaps 44 can be pressed together via the gripping parts 46, which project downward, and in this way, the locking lugs 45 are moved out of the corresponding indentations 47. With the removal of the magazine 5, the cocking device is automatically uncocked, which is explained in more detail, below, with the aid of FIGS. 1-4.

If the magazine 5 is found in the incorporation position, shown in accordance with FIG. 1, and the locking lugs 45 mesh into the corresponding indentations 47 in the magazine well 4, then the front ends 41 of the rocker levers 36 are pressed upward by the upper border 42 on the housing 43 of the magazine 5. In this way, the two pressure pins 35 are pressed downward against the forces of the pressure springs located around them. The blocking element 29, also acted on, downward, by a spring which is not depicted, is likewise found in a lower position and the catch plate 25 fits tightly, with its rear, round end surface 27, on the corresponding placement surface 28 of the blocking element 29. In the position shown in FIG. 1, the cocking slider with the upper and lower cocking slider parts 13 and 14 is found in a lower uncocking position, in which the cocking pin 17 is retracted via the articulated lever 16 and the fork piece 15, and the striker spring 48, shown in FIG. 3, is uncocked.

If the cocking slider with an inserted magazine 5 is pushed from the lower uncocking position, shown in FIG. 1, into the cocking position, shown in accordance with FIG. 2, by pressure on the upper cocking slider part 13, and in this way, the cocking pin 17 is pushed forward via the articulated lever 16 and the fork piece 15 in order to cock the striker spring 48, shown in FIG. 3, the cocking slider can mesh by placement of the catch 21 on the mating catch 23 of the catch plate 25, held by the blocking element 29 in the front catch position, as is shown in FIG. 2. The bolt is cocked in this position in which the rear end of the upper cocking slider part 13 is raised slightly from the breech housing 2.

To uncock the bolt, the only thing needed is to press on the rear end of the upper cocking slider part 13. In this way, the catch 21 on the lower cocking slider part 14 is pressed out, downward, from the mating catch 23 of the catch plate 25 and the cocking slider is again pressed back into its uncocking position, shown in FIG. 1, due to the effect of the striker spring 48.

If, however, the magazine 5 is not inserted correctly or is taken out of the magazine well 4, in accordance with FIG. 3, the front ends 41 of the rocker levers 36 can move downward, and, in this way, the pressure pins 35 can move upward due to the effect of the pressure springs. The blocking element 29 is raised by the pressure pins 35 moving upward, wherein the rear end 27 of the catch plate 25 is lifted out of the mating catch 28 on the blocking element 29, and the catch plate 25 arrives at a rear detachment position, shown in FIG. 3, from the front catch position shown in FIG. 2, together with the cocking slider, due to the effect of the striker spring 48. The cocking pin 17 is also retracted via the fork piece 15 and the articulated lever 16 and the striker spring 48 is uncocked. With the removal of the magazine 5, therefore, the striker spring 48 is automatically uncocked. Only when the magazine 5 is again properly inserted and locked can the catch plate 25, dragged along by the cocking slider during the pushing up, again arrive for placement with its lower end surface 27 at the placement surface 28 of the blocking element 29, which is then, once again, lowered, wherein a renewed cocking of the striker spring 48 is made possible.

The invention claimed is:

1. Cocking device for a bolt mechanism with a cocking slider (13, 14), which can be displaced between a rear uncocking position and a front cocking position, on a breech housing (2), for the cocking and uncocking of a striker spring (48) and a catch (21), which is located on the cocking slider (13, 14) and which acts together with a mating catch (23) to hold the cocking slider (13, 14) in the front cocking position, wherein when a magazine (5) is removed, an uncocking mechanism (25, 29) for the automatic uncocking of the striker spring (48), is correlated with the cocking slider (13, 14).

2. Cocking device according to claim 1, wherein the uncocking mechanism (25, 29) contains a catch plate (25) which can be displaced in the breech housing (2) between a rear safety position and a front catch position, on which the mating catch (23) for the catch (21) of the cocking slider (14, 15) is located.

3. Cocking device according to claim 2, wherein the uncocking mechanism (25, 29) contains a blocking element (29), located in the breech housing (2), which holds the catch plate (25) in the front catch position when a magazine (5) has been properly inserted, and releases the catch plate (25) for displacement into the rear safety position when the magazine (5) has been removed.

4. Cocking device according to claim 3, wherein the blocking element (29) can move, via an actuation mechanism (34, 35, 36), located in a system casing (1), between a lowered position to hold the catch plate (25) in the front catch position and a raised position to release the catch plate (25) for its displacement into the rear safety position.

5. Cocking device according to claim 4, wherein the actuation mechanism (34, 35, 36) comprises one or more pressure pins (35) located in a displaceable manner on a carrier (34), which can be moved into a retracted position via rocker levers (36) when the magazine (5) has been inserted, and by pressure springs into an extended position for the displacement of the blocking element (29) into the raised position for the release of the catch plate (25) when the magazine (5) has been removed.

6. Cocking device according to claim 5, wherein the blocking element (29) has two connecting pieces (30), which project downward for meshing with two pressure pins (35), at a distance from one another.

7. Cocking device according to claim 3, wherein the blocking element (29) is constructed as a blocking fork, with a placement surface (28) for a rear end surface (27) of the catch plate (25), and a passage (31) located below the placement surface (28) for the catch plate (25).

8. Cocking device according to claim 2, wherein the catch (23) is located at the rear end of a longitudinal hole (24) located in the catch plate (25).

9. Cocking device according to claim 2, wherein the catch plate (25) is located between an upper area (18) and a lower catch cross-link (20) of a lower cocking slider part (14) of the cocking slider (13, 14).

10. Cocking device according claim 1, wherein a trigger guard (6) and a trigger (7) are located on the magazine (5).

* * * * *